United States Patent [19]

Christoff

[11] 4,102,066

[45] Jul. 25, 1978

[54] SCARIFYING APPARATUS AND METHOD FOR RAILROAD BED BALLAST REMOVAL

[76] Inventor: James W. Christoff, R.R. #1, Box 199, Crete, Ill. 60417

[21] Appl. No.: 795,717

[22] Filed: May 11, 1977

[51] Int. Cl.[2] ..... E02F 5/22; E01B 29/06

[52] U.S. Cl. ..... 37/104; 104/9; 37/195

[58] Field of Search ..... 37/104–106, 37/195; 104/9; 171/16

[56] References Cited

U.S. PATENT DOCUMENTS

| | | | |
|---|---|---|---|
| 2,242,793 | 5/1941 | Philbrick | 37/104 X |
| 2,463,499 | 3/1949 | Thornley | 37/104 |
| 2,574,118 | 11/1951 | McWilliams | 37/104 |
| 2,669,041 | 2/1954 | Fox et al. | 37/104 |
| 2,743,539 | 5/1956 | Hursh et al. | 37/104 |
| 2,855,706 | 10/1958 | Rushmer | 37/104 |
| 2,924,030 | 2/1960 | Pedigo | 37/104 |
| 2,991,988 | 7/1961 | Kershaw | 37/104 X |
| 3,553,859 | 1/1971 | McIlrath | 37/104 |
| 3,826,195 | 7/1974 | Bucksch | 104/2 |
| 4,047,486 | 9/1977 | Pabsdorff | 37/106 X |

FOREIGN PATENT DOCUMENTS

| | | | |
|---|---|---|---|
| 267,818 | 12/1934 | Italy | 37/105 |
| 55,314 | 8/1911 | Switzerland | 37/105 |
| 796,076 | 6/1958 | United Kingdom | 37/104 |
| 881,964 | 11/1961 | United Kingdom | 37/104 |

*Primary Examiner*—E. H. Eickholt

*Attorney, Agent, or Firm*—Haight, Hofeldt, Davis & Jambor

[57] ABSTRACT

Railroad bed scarifying apparatus employing a digging or scooping action along the direction of the rails is provided. A movable frame mounted on a vehicle which travels along the rails has three digging plates pivotally mounted thereon. A first digging plate extends between the rails, while the other two digging plates each extend outwardly from an associated one of the rails to the end of the ties. Each of the digging plates has a digging ridge located on the end thereof, the digging ridge being located at an obtuse angle with respect to the front surface of the digging plate. By appropriate control of suitable driving arrangements, the digging ridges and digging plates form a trench of the appropriate dimensions to receive a tie and place the removed ballast on an adjacent tie for return after insertion of the new tie.

9 Claims, 10 Drawing Figures

SCARIFYING APPARATUS AND METHOD FOR RAILROAD BED BALLAST REMOVAL

BACKGROUND OF THE INVENTION

1. Field of the Invention

The present invention relates generally to an apparatus and method for scarifying railroad beds, and more specifically, the present invention relates to an apparatus and method for forming a trench under a pair of parallel railroad tracks or rails and between an adjacent pair of ties contributing to the support of the rails.

2. Description of the Prior Art

Parallel tracks or rails for railroad trains are supported by wooden cross ties (generally referred to merely as "ties") located at spaced intervals along the tracks. These wooden ties decompose, work loose, or otherwise break or become insufficiently strong to support the rails and the trains that they carry. Accordingly, it is necessary to replace the wooden ties at periodic intervals.

Railroad bed ties are secured in place by various materials, all generally referred to as ballast. This ballast may be gravel, rocks, dirt, combinations thereof, or any other suitable materials. Thus, in replacing a tie, it is necessary to remove the ballast in order to insert the new tie under the railroad tracks. A trench formed in the ballast to receive the tie should have the desired shape to receive the tie and should place the ballast in a handy location for return after the new tie has been placed.

Various attempts have been made in the past to scarify or remove the ballast to provide the desired trench for the tie and appropriately handle the ballast. Such devices normally employ an action parallel to the ties. Such prior art devices involve a number of difficulties. For one thing, since they must work from outside the rails, they are normally cumbersome and difficult to operate. In addition, the resulting trenches are frequently not of the proper shape and location to easily receive the tie. Further, such devices normally deposit the ballast removed from under the tracks to one or both sides of the rails, so that it is difficult to return this ballast once the new tie is in place.

At least one prior art device has attempted to avoid the problems of these approaches by utilizing a plurality of rotating drums having an axis parallel to the ties. While such an approach more conveniently places the removed ballast on an adjacent tie, the radius of curvature results in a rounded bottom of the trench, which is undesirable for receiving the flat ties. In addition, if the drums are made sufficiently large to give a larger area at the bottom of the trench, there is considerable risk of disturbing adjacent ties.

Accordingly, prior art railroad bed scarifying apparatuses and methods have been less than completely satisfactory.

SUMMARY OF THE INVENTION

To obviate the difficulties of the prior art devices, applicant employs a digging action along the rails or tracks, so that the removed ballast is located on an adjacent tie for easy return once the new tie is in place. To achieve this desired result, while yet accurately forming a trench of the desired dimensions to receive a tie, applicant employs a specially designed structure having a desired sequence of steps to remove the railroad bed ballast and provide the desired trench.

The structure of the present invention is mounted on a vehicle that moves along the tracks, such as conventional work vehicles of this type. A frame is mounted on the vehicle with the capability of raising and lowering motions. These types of motions may be achieved by employing L-shaped side bars for the frame, with the end of the leg of the L-shaped side bar being pivoted on the vehicle. The legs of the L-shaped side bars extend forwardly with a generally horizontal deployment. A suitable driving arrangement, such as a pair of hydraulic cylinders with one of the cylinders attached to each of the L-shaped side bars, may be employed to rotate the frame, which provides a generally vertical motion over the small amount of arc in which it is moved. The dowwardly extending, generally vertical feet of the L-shaped side bars each have a supporting bracket pivoted at the end thereof. These pivoted brackets are secured to a shaft that extends parallel to the ties.

A plurality of digging plates, preferrably three, so that one digging plate extends between the tracks, while each of the other digging plates extends outwardly from an associated track to the end of the ties, are commonly mounted on the shaft. Each of the digging plates has an insertion portion or digging ridge located at the end thereof. This digging ridge may be serrated or toothed, and it is positioned at an obtuse angle with respect to the front surface of the associated digging plate. A suitable driving arrangement, such as another pair of hydraulic cylinders, is utilized to pivot the brackets and connected digging plates.

A pair of retractable arms is mounted on the digging plates. These arms are extended under the rails during the trench forming motion in order to remove the ballast under the rails. These retractable arms may be secured at the ends of respective supporting rods, each of which is preferrably pivoted on an associated one of the digging plates extending outwardly from the tracks. Suitable driving arrangements, such as hydraulic cylinders mounted on the digging plate extended between the tracks, may be utilized to extend and retract the retractable arms.

With this structure, and by utilizing a preferred sequence of operations, the digging plate may be brought very close to adjacent ties without disturbing them, while yet accurately forming the trench to receive the new tie. To achieve this, applicant initially causes the digging plates to be pivoted so that the digging ridge is substantially vertical to the railroad bed ballast. The frame is then lowered to drive the digging ridge through the ballast to the desired depth. The digging plates are then rotated to place them in a substantially vertical position. At this point, the retractable arms are extended under the tracks or rails. The vehicle is then moved forward to basically form the trench into which the tie will be inserted. The retractable arms are then retracted, while the digging plates are pivoted forward and upward to complete the digging operation. Then the frame is raised to place the apparatus in condition for the next scarifying operation.

With this arrangement, applicant accurately forms the tie receiving trench without disturbing adjacent ties. Also, the ballast is located on the next forward tie for easy return to the railroad bed when the tie has been replaced. All this is achieved with a relatively simple apparatus and method.

These and other objects, advantages and features of this invention will hereinafter appear, and for purposes of illustration, but not of limitation, an exemplary embodiment of the subject invention is shown in the appended drawing.

DETAILED DESCRIPTION OF THE PREFERRED EMBODIMENT

Figure 1:
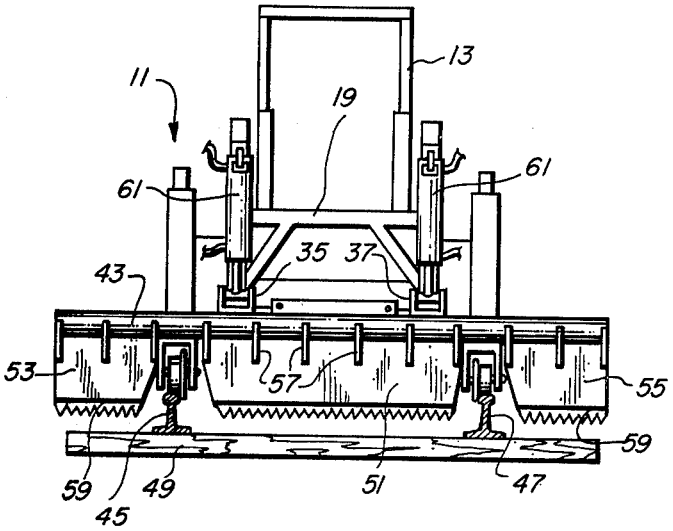
FIG. 1 is a front elevational view of a vehicle equipped with the scarifying apparatus of the present invention.
Figure 2:
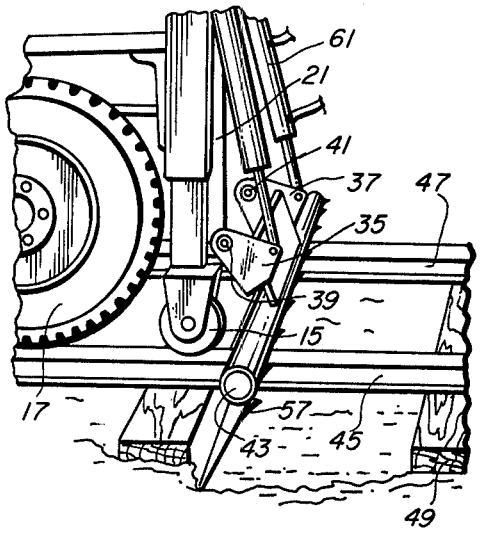
FIG. 2 is a partial side elevational view of the vehicle and scarifying apparatus of FIG. 1.
Figure 3:
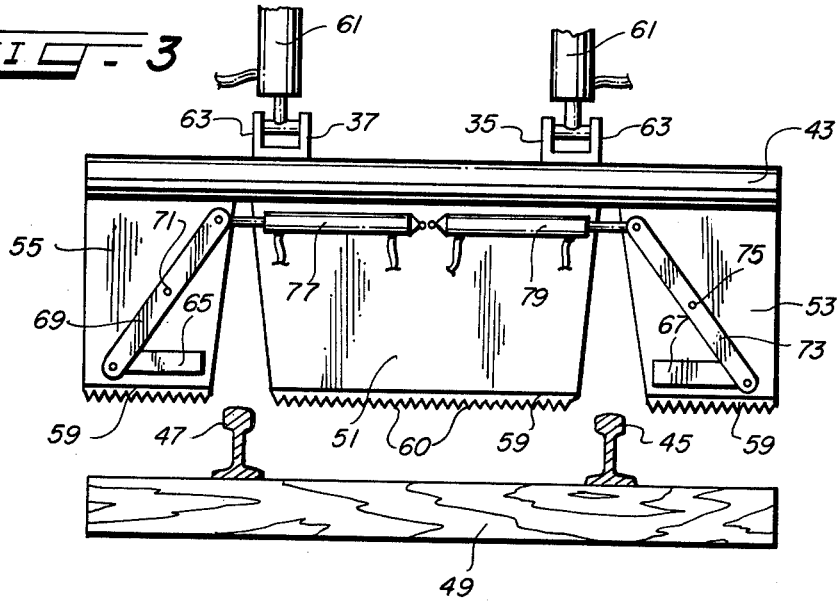
FIG. 3 is a rear elevational view of a portion of the scarifying apparatus of FIG. 1.

In FIG. 1 there is illustrated a scarifying apparatus 11 mounted on a vehicle 13. Vehicle 13 is a conventional wheeled vehicle of the type utilized in railroad construction and repair work. The particular type of vehicle illustrated in these drawings has rail fitting wheels 15 and larger rubber tires 17.

The scarifying apparatus 11 has a frame 19 mounted on the vehicle 13. As may be better seen in FIGS. 5–10, frame 19 has an L-shaped side bar 21 on each side of the vehicle 13. L-shaped side bar 21 has a forwardly extending, generally horizontal leg 23 and a downwardly extending, generally vertical foot 25. The end of leg 23 is pivotally mounted on vehicle 13 at point 27.

With the arrangement shown, the frame 19 may be raised and lowered. Although the side bar 21 is pivoted about point 27, the relatively long leg 23 results in foot 25 exhibiting a substantially vertical movement over short distances of rotation of leg 23. L-shaped side bar 21 may be driven by any suitable arrangements, but in this preferred embodiment the drive arrangement is illustrated as a hydraulic (or pneumatic) cylinder 29. Hydraulic cylinder 29 is secured to vehicle 13 at point 31, while being attached to the foot 25 of side bar 21 through the linkage 33.

A pair of brackets 35 and 37 are pivotally mounted on respective feet 25 of L-shaped side bars 21. These pivotal mountings are shown as 39 for bracket 35 and as 41 for bracket 37. Brackets 35 and 37 support a shaft 43. Shaft 43 is transverse to the parallel tracks or rails 45 and 47, which are supported by wooden ties 49. Shaft 43 may be formed of any suitable hard material.

Digging plates 51, 53 and 55 are commonly mounted on the shaft 43. Digging plates 51, 53 and 55 are rigidly secured to shaft 43 with the aid of supporting angle 57. Digging plate 51 extends between rails 45 and 47, preferrably covering as much of the distance between the rails or tracks 45 and 47 as possible. Digging plates 53 and 55 extend outwardly from the respective rails 45 and 47 to or slightly beyond the ends of the ties 49.

Each of the digging plates 51, 53 and 55 has an insertion portion or digging ridge 59 located at the end thereof. These digging ridges 59 are secured to the digging plates 51, 53 and 55 in any suitable fashion, while being positioned at an obtuse angle with respect to the front surfaces of the digging plates. The exact magnitude of the obtuse angle is established by various considerations, but the major purpose of the obtuse angle is to permit the operational sequence hereinafter described in detail. Digging ridges 59 have teeth or serrations 60 to improve the ballast entry characteristics of these digging ridges.

A suitable driving arrangement for the brackets 35 and 37, and hence the shaft 43 and digging plates 51, 53 and 55, is provided. In this preferred embodiment, the driving arrangement is a pair of hydraulic or pneumatic cylinders 61 mounted on frame 19 at the upper portion of feet 25, each of which is secured to a corresponding bracket 35 or 37 at point 63.

Figure 4:
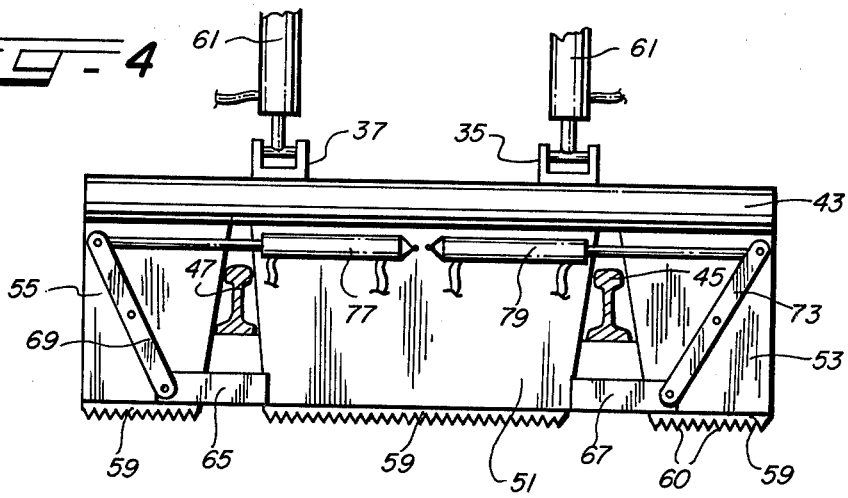
FIG. 4 is a rear elevational view corresponding to FIG. 3 in another state of operation.

In order to provide for clearing the ballast under rails 45 and 47, retractable arms 65 and 67 are provided. Retractable arm 65 is secured to a support rod 69 pivotally mounted on digging plate 53 at point 71. Similarly, retractable arm 67 is secured to a support rod 73 which is pivotally mounted on digging plate 55 at point 75. A suitable driving arrangement for retractable arm 65 and 67, such as hydraulic cylinders 77 and 79, is provided. As illustrated in FIG. 4, when the driving plates 51, 53 and 55 have been forced into the ballast in preparation for forming the trench to receive the tie, cylinders 77 and 79 actuate the retractable arms 65 and 67 to extend them under tracks 45 and 47.

Figures 5, 6, 7, 8, 9, 10:
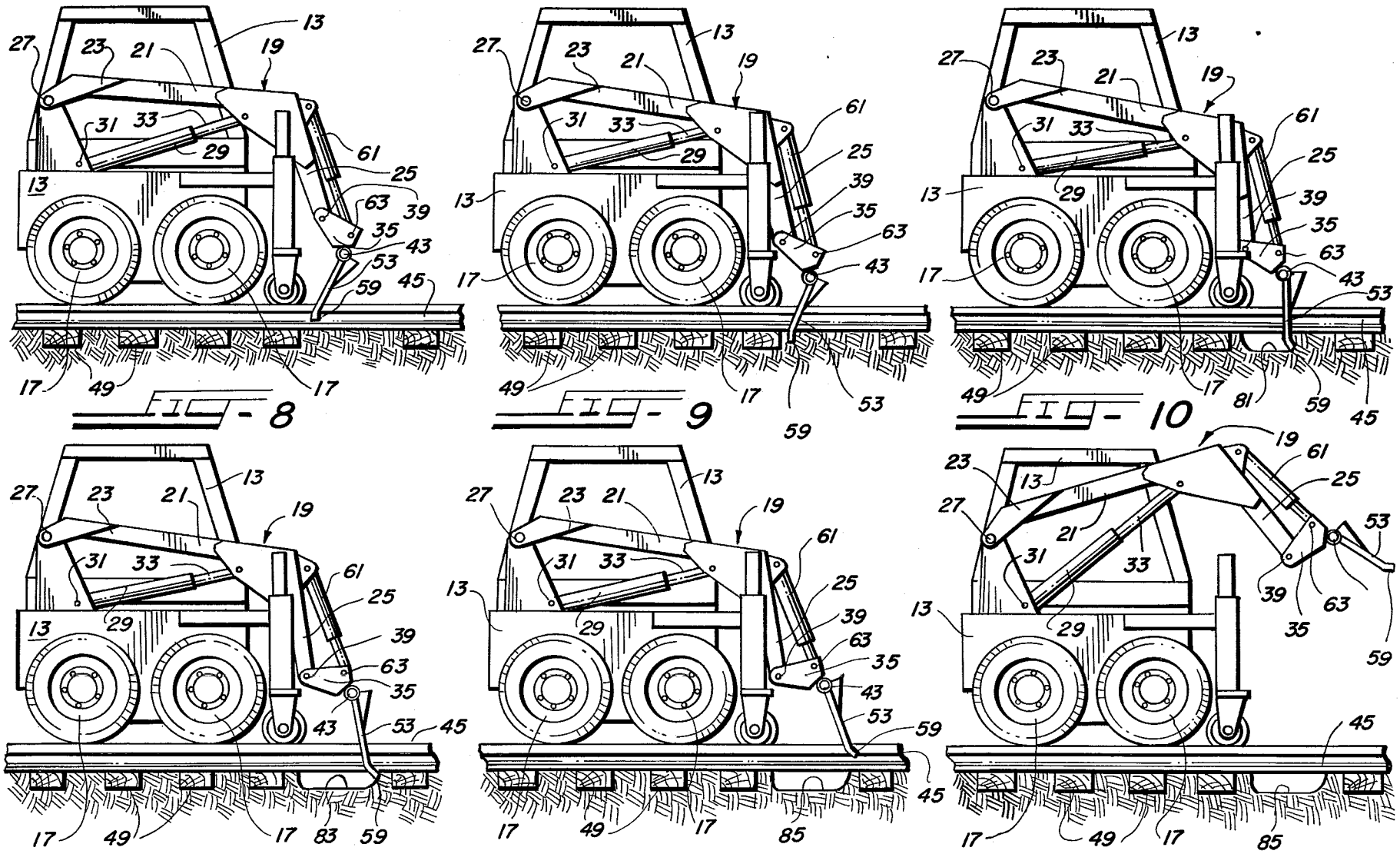
FIG. 5 is a schematic side elevational view of the apparatus of the present invention at the beginning of operation.
FIG. 6 is a schematic side elevational view corresponding to FIG. 5 at a subsequent time in the scarifying operation.
FIG. 7 is a schematic side elevational view corresponding to FIG. 6 at a later step in the scarifying process.
FIG. 8 is a schematic side elevational view corresponding to FIG. 7 at a still later point in the scarifying process.
FIG. 9 is a schematic side elevational view corresponding to FIG. 8 illustrating the termination of the digging operation.
FIG. 10 is a schematic side elevational view corresponding to FIG. 9 with the apparatus ready to return to the starting position of FIG. 5.

By reference now to FIGS. 5–10, the steps by which the scarifying apparatus described above may be utilized to achieve the desired results possible with this invention are illustrated. In FIG. 5, the scarifying apparatus is in a standby condition. Preparatory to initiating the digging operation, digging plates 51, 53 and 55 are rotated to a point at which digging ridges 59 are substantially perpendicular to the railroad bed. This is achieved by actuation of hydraulic cylinders 61.

After digging ridges 59 have been pointed substantially straight down at the ballast of the railroad bed, hydraulic cylinders 29 are actuated to drive frame 19 downward to the position illustrated in FIG. 6. Hydraulic cylinders 61 are then actuated again to position digging plates 51, 53 and 55 in a substantially vertical plane. Then, cylinders 77 and 79 are actuated to extend retractable arms 65 and 67 under the track.

At this time, the vehicle 13 is driven forward to the position of FIG. 7 to remove the ballast and form the trench illustrated at 81. Upon reaching the position of FIG. 7, cylinders 77 and 79 are again actuated to retract the arms 65 and 67. As illustrated in FIG. 8, hydraulic cylinders 61 are actuated to rotate the digging plates 51, 53 and 55 to provide the further refined trench 83. The rotation caused by the driving cylinders 61 is continued until the final version of the trench 85 is achieved as illustrated in FIG. 9. Finally, cylinders 21 are actuated to raise the frame 19 to drop off any ballast left on the digging plates and prepare the apparatus for the next cycle of operation. As the ballast has been merely shoved forward onto the next adjacent tie, it is readily available to be replaced in trench 85 after the tie has been inserted.

It should be understood that various modifications, changes and variations may be made in the arrangement, operations and details of construction of the elements disclosed herein without departing from the spirit and scope of this invention.

I claim:

1. Scarifying apparatus for removing ballast from a railroad bed, to permit the insertion of a cross tie under a pair of parallel rails supported by the ties, the scarifying apparatus being mounted on a vehicle movable along the rails and comprising:

a frame movably mounted on the vehicle;

a first digging plate pivotally mounted on said frame along an axis transverse to the rails, said first digging plate extending between the rails;

a second digging plate pivotally mounted on said frame along an axis transverse to the rails, said second digging plate being located outwardly of one of the rails;

a third digging plate pivotally mounted on said frame along an axis transverse to the rails, said third digging plate being located outwardly of the other rail;

each of said digging plates having an insertion portion along the outer edge thereof, each of said insertion portions being positioned at an obtuse angle with respect to the forward surface of the respective digging plate;

first driving means to move said frame;

second driving means to pivot said digging plates, said first and second driving means actuated at appropriate times in conjunction with a predetermined movement of the vehicle to form a tie receiving trench of the proper dimensions with the removed ballast being positioned for refilling of the trench;

a first retractable arm to be extended under one of the rails during the trench forming operation while being retracted during the lowering and raising of said digging plates;

a second retractable arm to be extended under the other rail during the trench forming operation while being retracted during the lowering and raising of said digging plates; and third driving means to extend and retract said retractable arms.

2. Scarifying apparatus as claimed in claim 1 wherein:

said first retractable arm is mounted on said second digging plate;

said second retractable arm is mounted on said third digging plate; and said third driving means comprises a pair of pneumatic cylinders mounted on said first digging plate, each of said cylinders driving an associated one of said retractable arms.

3. Scarifying apparatus as claimed in claim 1 wherein said digging plates are simultaneously pivoted by said second driving means.

4. Scarifying apparatus as claimed in claim 3 wherein said digging plates are commonly mounted.

5. Scarifying apparatus as claimed in claim 4 wherein said digging plates are mounted on a common shaft, said shaft being affixed to a pair of spaced brackets pivotally mounted on said frame.

6. Scarifying apparatus as claimed in claim 1 wherein said first and second driving means comprise hydraulic cylinders mounted on the vehicle.

7. Scarifying apparatus as claimed in claim 1 wherein said insertion portions on said digging plates comprise toothed digging ridges.

8. Scarifying apparatus for removing ballast from a railroad bed to permit the insertion of a cross tie between a pair of adjacent ties and under a pair of parallel rails supported by the ties, the scarifying apparatus being mounted on a vehicle movable along the rails and comprising:

a frame having a pair of L-shaped side bars, each of said side bars having a generally horizontal, forwardly extending leg and a generally vertical, downwardly extending foot, the ends of the legs of said L-shaped side bars being pivotally mounted on the vehicle;

a first pair of hydraulic cylinders mounted on the vehicle, each of said hydraulic cylinders connected to an associated one of said L-shaped side bars to selectively pivot said frame;

a pair of brackets, each of said brackets being pivotally mounted on the end of a corresponding one of the feet of said L-shaped side bars;

a second pair of hydraulic cylinders mounted on said frame, each of said hydraulic cylinders connected to an associated one of said brackets to selectively pivot said brackets;

a shaft transverse to the rails and parallel to the ties secured to said brackets;

first, second, and third digging plates commonly mounted on said shaft, said first digging plate extending between the rails, while said second and third digging plates each extend outwardly from an associated rail to the ends of the ties;

toothed digging ridges located on the ends of each of said digging plates, said toothed digging ridges being positioned at an obtuse angle with respect to the front surfaces of said digging plates;

a pair of retractable arms, each of said retractable arms being attached to a corresponding support rod pivotally mounted on an associated one of said second and third digging plates; and a third pair of hydraulic cylinders, each attached to an associated one of said support rods to extend said retractable arms under the rails during the formation of a trench for the tie and to retract said retractable arm upon lowering and raising of said digging plates.

9. A method of forming a trench for a cross tie in a railroad bed by removing ballast under parallel rails supported by the ties, employing a frame mounted on a vehicle movable along the rails, the frame being adapted to be raised and lowered, three digging plates pivotally mounted on the frame and extending along the ties transverse to the rails, with digging ridges located on the ends of the digging plates and positioned at an obtuse angle with respect to the front surfaces of the digging plates, and retractable arms mounted on the digging plates to be extended under the rails, comprising the steps of:

positioning the digging ridges of the digging plates generally perpendicular to a railroad bed while the frame is raised;

lowering the frame to drive the digging ridges of the digging plates down through the ballast;

pivoting the digging plates to a substantially vertical alignment;

extending the retractable arms under the rails;

moving the vehicle forward to cause the digging plates and retractable arms to form the trench for the tie;

retracting the retractable arms from under the rails;

pivoting the digging plates forward and upward to complete the digging operation; and raising the frame to empty any retained ballast and prepare for the next digging operation.

* * * * *